United States Patent [19]

Gach et al.

[11] Patent Number: 4,747,500

[45] Date of Patent: May 31, 1988

[54] TAMPER INDICATING TRANSPARENT CLOSURE

[75] Inventors: Peter P. Gach; Randall K. Julian, both of Evansville, Ind.

[73] Assignee: Sunbeam Plastics Corporation, Evansville, Ind.

[21] Appl. No.: 868,713

[22] Filed: May 30, 1986

Related U.S. Application Data

[63] Continuation-in-part of Ser. No. 693,328, Jan. 22, 1985, which is a continuation-in-part of Ser. No. 465,817, Feb. 14, 1983, abandoned, which is a continuation-in-part of Ser. No. 439,742, Nov. 8, 1982, abandoned.

[51] Int. Cl.[4] ..... B65D 51/22

[52] U.S. Cl. ..... 215/250; 215/349; 220/258; 220/377

[58] Field of Search ..... 215/250, 252, 257, 258, 215/341, 343, 345, 346, 347, 349, 350, 351; 220/377, 258

[56] References Cited

U.S. PATENT DOCUMENTS

| | | | |
|---|---|---|---|
| 660,739 | 10/1900 | Taylor | 220/377 X |
| 1,186,900 | 6/1916 | Heath | 215/253 |
| 1,670,450 | 5/1928 | Henry | 215/250 |
| 1,762,342 | 6/1930 | Merolle et al. | 215/250 |
| 1,837,618 | 12/1931 | Gutmann . | |
| 1,916,977 | 7/1933 | Gutmann | 215/329 |
| 1,966,273 | 10/1934 | Waring . | |
| 1,979,458 | 11/1934 | Eisen . | |
| 2,016,936 | 10/1935 | Waring . | |
| 2,018,061 | 10/1935 | Gillen et al. . | |
| 2,055,625 | 9/1936 | Heckel et al. | 215/347 |
| 2,068,389 | 1/1937 | Smith . | |
| 2,131,774 | 10/1938 | Waring . | |
| 2,131,775 | 10/1938 | Waring . | |
| 2,188,946 | 2/1940 | Gutmann . | |
| 2,388,738 | 11/1945 | Gudheim . | |
| 2,646,183 | 7/1953 | Pellett | 215/347 |
| 2,721,686 | 10/1955 | Reifsnyder et al. | 229/5.5 |
| 3,122,990 | 3/1964 | Fried | 270/377 X |
| 3,489,307 | 1/1970 | Wenger | 215/351 X |
| 3,501,042 | 3/1970 | Risch et al. . | |
| 3,612,325 | 10/1971 | Williams | 215/350 X |
| 3,709,395 | 1/1973 | Brennan et al. . | |
| 3,924,772 | 12/1975 | Magnani | 215/276 |
| 3,968,823 | 7/1976 | Simon . | |
| 4,176,757 | 12/1979 | Podesta | 215/341 |

FOREIGN PATENT DOCUMENTS

| | | | |
|---|---|---|---|
| 208484 | 12/1955 | Australia | 215/346 |

*Primary Examiner*—Stephen Marcus
*Assistant Examiner*—Bryon Gehman
*Attorney, Agent, or Firm*—Irvin L. Groh; Alfred L. Patmore, Jr.

[57] ABSTRACT

A tamper indicating closure for use with a container having a neck with an opening in which at least a portion of the closure is transparent. A destructible seal is bonded to the container neck providing a hermetic seal which is visible through the closure to indicate package integrity or tampering. In some embodiments, a transparent insert member is provided through which the seal element is visible, and after removal of the seal element, the insert member serves to reseal the closure to the container neck. In some embodiments, access is obtained to the container by unthreading and removing the closure from the container neck and puncturing the destructible seal element. In other embodiments, the seal element is bonded to the flat closure top or the insert so that the seal element is fractured upon initial opening movement of the closure to remove it from the container neck.

18 Claims, 3 Drawing Sheets

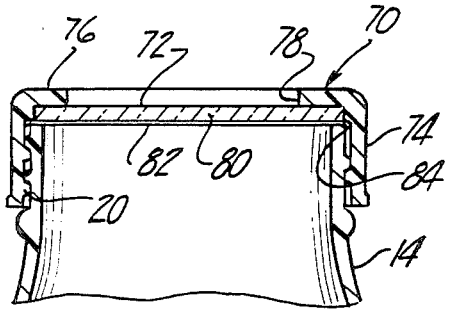
Fig-10
Fig-11
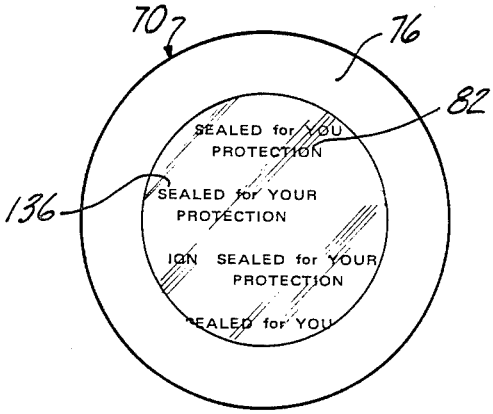
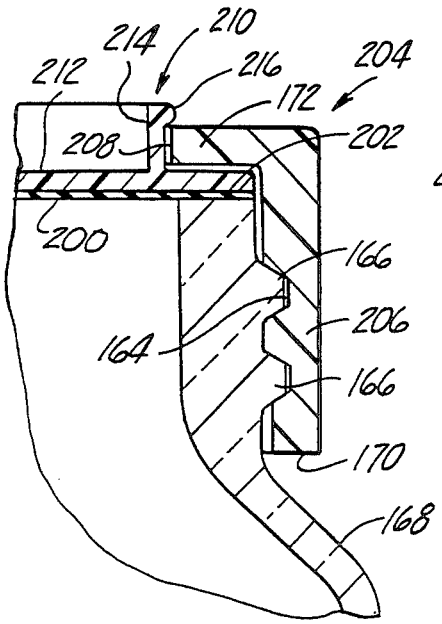
Fig-14
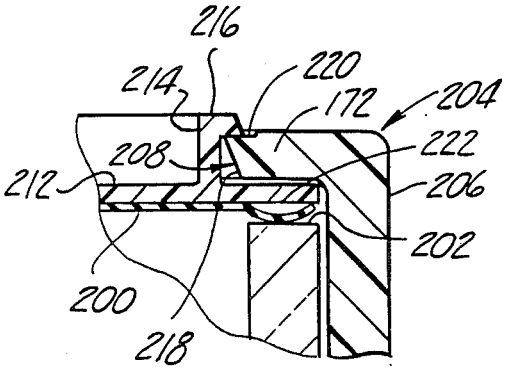
Fig-15

TAMPER INDICATING TRANSPARENT CLOSURE

This application is a continuation-in-part of application Ser. No. 693,328 filed Jan. 22, 1985 which is a continuation-in-part of application, Ser. No. 465,817 filed Feb. 14, 1983 and now abandoned, which is a continuation-in-part of application Ser. No. 439,742 filed Nov. 8, 1982 and now abandoned.

This invention relates to closures for containers and more particularly to closures of the type which indicate tampering.

There are a large variety of closures for containers which attempt to give evidence that the container has been opened or at least been placed in a condition for opening once it has been filled. The purpose of such closures is to insure that consumers can be confident that a closure has remained in a closed position once it has been filled and that it has not been opened prior to its purchase. However, many of such closures can be overcome by careful manipulation.

One such form of closure utilizes a destructible seal which covers the opening to the container and is bonded to the perimeter of the opening. The seal is protected from premature damage by a cap screwed or snapped onto the container. Access to the contents of the container requires removal of the cap and puncturing the seal. Consequently, removal of the cap gives visual evidence of whether or not the container has remained sealed since it originally was filled. However, with such containers and closures, the seal can be punctured and the customer is not made aware of the condition of his purchase until the cap is removed. Also, the seal can be completely removed and unless the consumer is familiar with the packaging or has another container with which the open container can be compared, the consumer can be unaware that there has been a prior opening.

In the present invention, a tamper indicating closure can be attached to a container in any conventional manner, such as by threads or snap locks and can be any one of a number of child resistant types. The closure is made at least in part of transparent material and incorporates a seal of plastic treated foil or treated papers such as glassine. The underside of the seal is provided with a pressure sensitive adhesive or in the case of foil, it can be treated with a coating of plastic. Consequently, after a container is filled with a product, the manufacturer applies the closure to the container to bring the underside of the seal into contact with the perimeter of the opening. In the case of adhesive, this causes a bonding and in the case of plastic foils the filled container and cap can be passed through an induction field to cause bonding. In either case a seal of the contents within the container occurs and the transparent closure makes the entire seal clearly visible so its integrity can be determined especially when compared with like containers in the same display.

In a second embodiment of the invention the top of the seal has a portion bonded to the underside of the cap. Opening movement requires either rotation or axial movement of the closure relative to the container and such movement fractures the seal element so that there is visual evidence that an effort has been made to open the container by removing the cap. Again, this is particularly evident when the package of the product is on shelves of a retail outlet where comparison can be made with like packages on display. However, even a single package gives evidence that there has been an effort at prior opening by the fracture of the seal. Such fracturing of the seal is emphasized by the use of contrasting indicia or colors for opposite sides of the seal.

In other embodiments of the invention, the seal is fastened to the underside of the cap by means integral with the cap and in still another embodiment of this invention, means are provided at the underside of the cap which permits turning movement of the cap relative to the seal on a container in the closing direction but act to engage and tear the seal if an effort is made to move the cap in an opening direction. In still another embodiment, the means for making the sealing element visible also provides the secondary seal for sealing the container after the primary foil or glassine seal has been punctured and removed.

Preferred embodiments of the invention are described with reference to the drawings in which:

FIG. 10 is a cross-section view of another embodiment of the invention;

FIG. 11 is a top view of the embodiment of the invention seen in FIG. 10;

FIG. 14 is a fragmentary elevational view of another embodiment of the invention; and FIG. 15 is a fragmentary view of a portion of the invention shown in FIG. 14.

Figure 1:
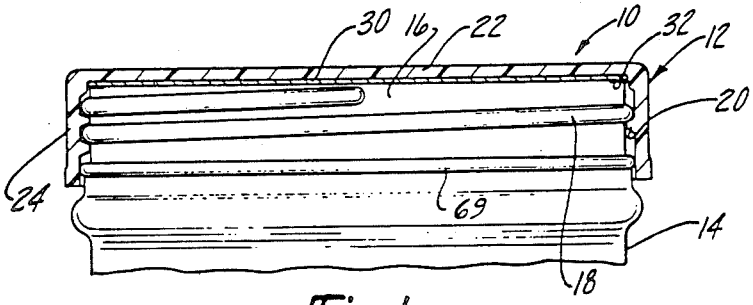
FIG. 1 is a cross-sectional view of a closure embodying the invention in closed position on the neck of a container which is shown in elevation.

A portion of a package 10 having a closure 12 embodying the invention and shown in closed position on a container 14 is illustrated in FIG. 1. The container 14 has a neck 16 provided with conventional screw threads 18 formed on the exterior of the neck 16 which are complementary to threads 20 formed on the closure 12.

The closure 12 has a flat disc shaped top 22 with a depending cylindrical skirt 24 the interior wall of which is formed with the threads 20. In the closed condition of the package 10, a seal 30 is disposed between the closure 12 and the container 14. The seal 30 is a thin membrane of treated paper such as glassine or plastic coated metal foil such as aluminum. The seal 30 is disposed within the closure 12 and has its perimeter portion 32 provided with a pressure sensitive adhesive such that when the closure 12 is applied to the container 14, the seal 30 is bonded to the sealing lip of container 14 to seal the contents within the container 14. In the case of a seal 30 made of metal foil, the underside of the seal can be treated with a coating of plastic material so that after the closure 12 is placed on the container 14 for the first time, the package 10 can be passed through an electric induction field causing the heat to bond the foil to the perimeter of the neck 16.

The cap is made of transparent material and in the closed position of package 10 the seal 30 on the container 14 is clearly visible through the closure 12. For this purpose the cap preferably is made of plastic such as polypropylene which has the property of giving contact clarity. By contact clarity it is meant that objects in contact such as the seal 30 are clearly visible whereas objects spaced slightly from the material are less definite. With the seal in contact with the underside of the closure 12 the condition of the seal 30 is readily apparent. Also the condition of the seal relative to the cap is less apparent in the event that the seal is slightly spaced from the closure 12 as would occur if a screw type cap has been loosened. Other plastic materials such as polyethylene also can be used to form closure 12 but are apt to give a less clear or milky appearance to objects.

After container 14 has been filled with the product to be packaged and the transparent closure 12 together with the seal 30 is brought into closing contact with the container 14 the seal 30 will be bonded to the perimeter of the neck 16 either by way of the pressure sensitive adhesive or by the subsequent induction heating of plastic coating of the metallic seal 30. Under these conditions the contents of the container 14 are sealed and the seal is visible through the transparent closure 12. When such packages 10 are displayed in side by side relationship at retail outlets, the consumer can readily view the condition of the seal through the transparent closure 12. If the seal 30 has been fractured or is absent, this indicates the possiblity of tampering so that the package can be removed from the display to prevent distribution to a consumer.

Figure 2:
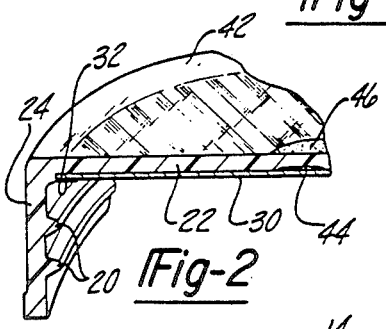
FIG. 2 is a fragmentary perspective view of one embodiment of the closure also shown in cross-section.
Figure 3:
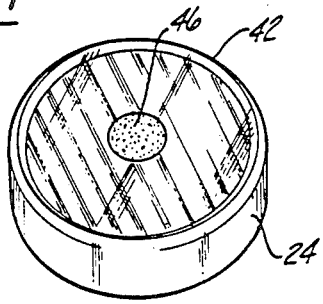
FIG. 3 is a perspective view of the entire closure seen in FIG. 2.
Figure 4:
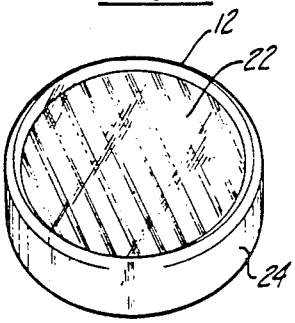
FIG. 4 is a perspective view of another embodiment of the invention.

In a second embodiment of the invention shown in FIGS. 2 and 3, a closure 42 can be identical in all respects to the closure 12 except that a top portion of seal 30 is bonded by means indicated at 44 to an underside of the flat top 22. This bond is a permanent bond created either by adhesive in the case the seal is of glassine or by fusion during induction heating in the case of plastic coated metal foil.

If desired the transparent closure 42 may have portions such as that indicated at 46 striped to make those portions of the closure opaque or only partially transparent. This makes it possible to provide contrasting areas concealing adhesive or screw threads and can be used to give a decorative appearance. However, a major portion of the top 22 preferably is transparent.

The seal 30 can be held in position within the closure 42 during application of the closure assembly to the container 14 during the packaging operation. The resultant package 10 is one in which the seal 30 has its perimeter bonded to the container 14 and a portion of the top of the seal bonded to closure 42. The appearance of the package 10 is as viewed in FIG. 5 in which the contents of the container are concealed by the seal 30 which in turn is clearly visible through the closure 42. The nature of the bonding is such that the attachments to the container 14 and to the closure 12 are permanent. As a consequence any relative movement of the closure 12 and container 14 will result in distortion and fracture of the seal 30.

Figure 5:
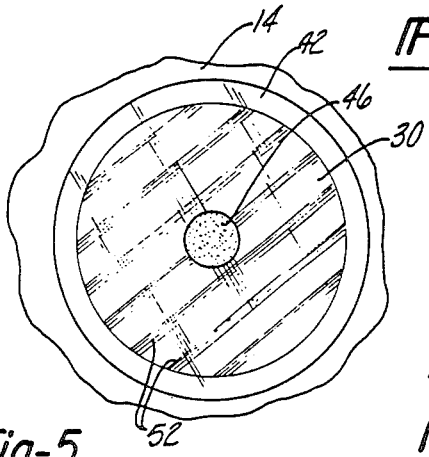
FIG. 5 is a top view of the closure and container of the embodiment of the invention seen in FIGS. 2 and 3 showing the condition of the package after it is first closed after filling.

Once an effort has been made to open the package 10 by removing the closure 42 the fractured seal 30 becomes visible through the top of the closure 42 and such fracture is readily apparent particularly when compared with like containers in which the seal 30 is intact as seen in FIG. 5.

Figure 6:
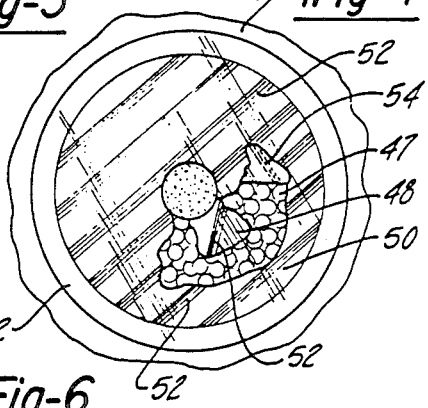
FIG. 6 is a view similar to FIG. 5 showing the condition of the package after an effort has been made to open it by movement of the closure from the container.

Upon fracture of the seal 30 it may have an appearance as viewed in FIG. 6 in which a portion of the seal 30 is torn away to make the contents 47 of the container 14 partially visible. Fragments such as that indicated at 48 may remain attached to the closure 42 and portions indicated at 50 may remain attached to the container 14. Various indicia such as contrasting printing or contrasting colors can be used to make the fracture more readily apparent. For example, with directionally disposed indicia such as the lines 52 the fragments 48 and 50 become more apparent because of the misalignment of the lines 52. Also portion of the seal 30 may be folded over as indicated at 54 in which event contrasting indicia such as printing or colors on the top and bottom side of the seal 30 will make the fracture of a seal more apparent.

Figure 7:
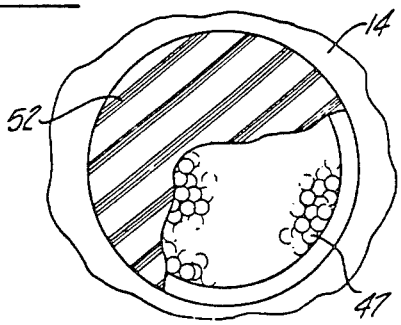
FIG. 7 is a view similar to FIG. 6 of the container with the closure removed and with a portion of the seal remaining attached to the container.
Figure 8:
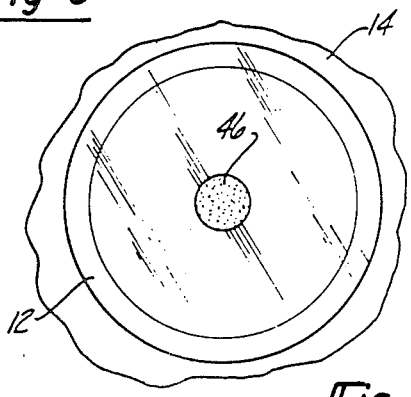
FIG. 8 is a view of the package after it has been opened and the seal has been completely removed and the closure is reattached to the container.

After the closure 42 is completely removed from the container 14, portions of the seal 30 will remain attached to the container 14 as viewed in FIG. 7. These fragments as well as those attached to the closure 42 can then be removed with the fingers. Upon replacement of the closure 42 to the container 12 the unsealed contents of the container are visible through the transparent portions of closure 42 and the absence of the seal 30 will be readily noticeable as viewed in FIG. 8, particularly when compared with like packages 10 which remained fully sealed.

Figure 9:
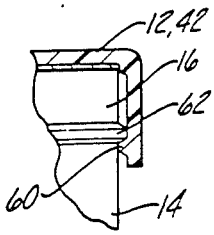
FIG. 9 is a partial view similar to FIG. 1 show in another arrangement for holding the closure on the container.

Although the embodiments of the invention have been disclosed in connection with a screw type closure 12 or 42, either form of closure could be the snap type which as viewed in FIG. 9 has a lock flange 60 formed on the neck of the container 14 and a complementary locking flange 62 formed on the inside of the closure. Removal of the closure 12 and 42 requires axial movement which in the case of the closure 42 results in rupture of the seal 30 upon relative axial movement and removal. The closures 12 and 42 also can be of various child proof type having locking features and requiring predetermined orientation or squeezing before opening can occur. In all such packages the closures are made wholly or partially transparent to make the membrane seal 30 visible and relative movement of the container and closure can be used to rupture a seal.

After the primary seal 30 has been removed from the container 14 the closure 12 can be reapplied to the container 14 in which case the bead 69 coacts with the interior surface of the skirt 24 as seen in FIG. 1 to form a seal to protect the remaining contents of the container 14.

Referring to FIGS. 10 and 11, another embodiment of the invention is illustrated in which a closure 70 has a disc shaped top 72 with a depending cylindrical skirt 74, the interior walls of which are formed with the threads 20. The disc shaped top 72 is made up of an annular flange 76 which is formed integrally with the skirt 74 and can be made of an opaque material. The annular flange 76 forms a port or opening 78 which is closed by a disc shaped liner 80 seated against the underside of flange 76 and within the closure 70. The liner 80 is fastened in position by any means including adhesion or snapped into position by an interference fit with the interior of skirt 74. The liner 80 is transparent and is made of relatively resilient and soft plastic, for example, a low density polyethylene with an ethylene acetate additive. This makes the liner 80 relatively soft and pliable to give it sealing characteristics and at the same time allows it to be transparent.

In the closed condition of a package, a destructible seal 82 similar to the seal 30 is disposed between the closure 70 and the container 14. As in the prior embodiments of the invention, the seal 82 can be bonded by adhesive or induction heating to the sealing lip of the container 14 to seal the contents within the container 14. After the package has been filled and sealed for the first time, the seal element 82 is clearly visible through the transparent line 80 to indicate its condition. If the seal element 82 has been fractured or is absent, tampering or prior opening is apparent and the package can be removed from the display to prevent distribution to consumers.

The various indicia such as contrasting printing or contrasting colors suggested as to the prior embodiments can be used to enhance detection of the seal element fracture. In FIG. 11 a repeated worded message 136 is used, serving the same purpose as the parallel line indicia 52 shown in FIGS. 5–7.

In normal use, the presence of absence of the seal can be noted through the transparent liner 80, and when the closure 70 is removed, the seal element can be broken and removed in its entirety to use the contents of the container 14. When only a portion of the contents are used, the closure can be replaced on the container 14 which will bring the underside of the liner 80 into sealing arrangement with the lip on the neck of the container 14. In this manner, the liner 80 not only provides a means by which the primary seal 82 can be observed, but after it has been removed, the liner 80 thereafter acts as the seal for the remaining contents of the container 14.

The destructible seal 82 can be applied to the container 14 separately from the underside of closure 80 or can be temporarily assembled to the inside of the closure by an interference fit afforded by the circumferential lip 84 of seal 82 so that the closure 70 and seal 82 can be applied to the container simultaneously.

Figure 12:
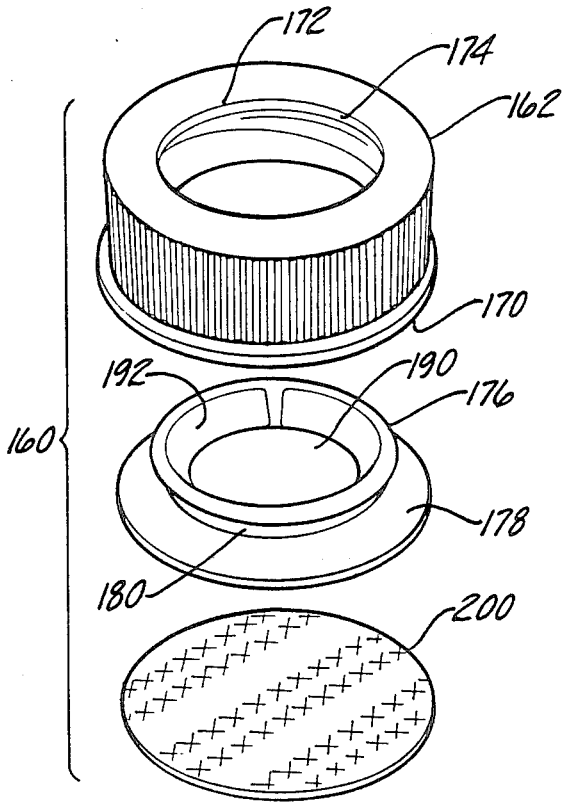
FIG. 12 is an exploded view in perspective of a closure forming another embodiment of the invention.
Figure 13:
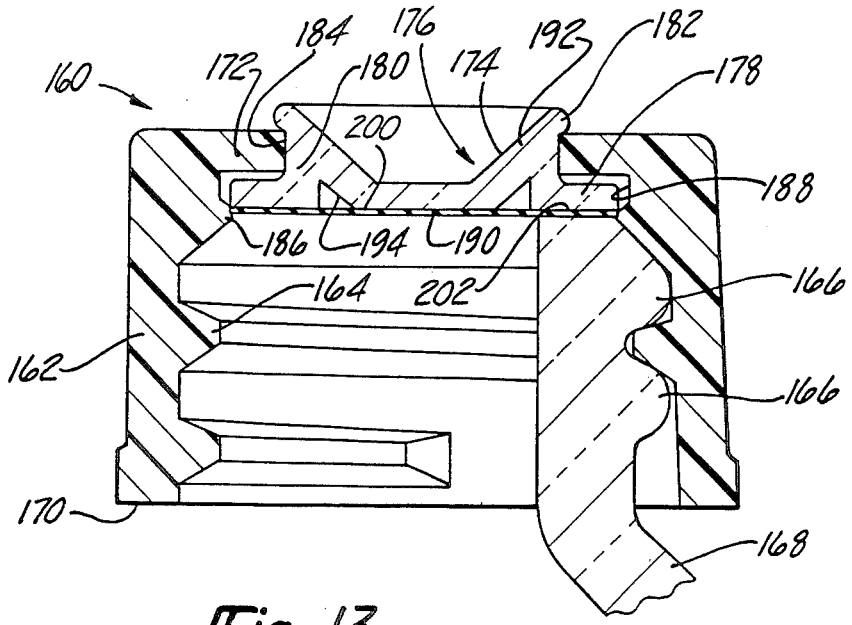
FIG. 13 is a sectional view with portions broken away showing the closure of FIG. 12 and its relationship to the container which is shown in elevation.

Still another embodiment of the invention is disclosed in FIGS. 12 and 13 in which the closure 160 includes a cylindrical body member 162 having internal threads 164 for engagement with complementary threads 166 on a neck of a container 168. THe cylindrical body member 162 is open at its opposite ends to form a lip 170 at the lower open end to receive the neck of the container 168. The opposite end of the body member 162 is provided with annular flange 172 forming an opening 174 to receive an insert member 176. The insert member 176 is generally hat shaped and the brim portion is formed by an annular flange 178. Flange 178 merges with an axially extending tubular portion 180 which projects through the opening 174. The upper end of the insert member 176 is provided with an annular bead 182 which together with the flange 178 forms a radially outwardly opening insert groove 184 which receives the flange 172 of the body member 162.

The body member 162 is provided with an internal shoulder 186 which acts with the flange 172 of the body member to form a body groove 188 between them for receiving the insert flange 178.

The insert member 176 is made of transparent polyethylene, a relatively soft material, and in assembly of the closure 160 is snapped into position so that it is free to rotate with the body member flange 172 in the insert groove and the insert flange 178 in the body groove 188. The insert member 176 is formed with a central portion 190 connected by frusto-conical wall portion 192 with the upper end of the tubular portion 180. This places the bottom surface of the central portion 190 in alignment with the bottom portion of the flange 178 of the insert member 176. Also the construction forms an annular groove 194 which separates the central portion 190 from flange 178.

The closure 160 also includes an adhesive faced printed seal element 200 which adheres to the underside of insert member 176 as it is held within body member 162.

The complete closure assembly 160 includes the body member 162, the insert member 176 and the seal element 200. Upon application of the closure 160 to the container, the body member 162 is rotated to bring the threads 164 and 166 into engagement with each other so that the closure 160 moves axially downwardly relative to the container 168. Upon engagement of the underside of the seal element 200 with the top lip 202 of container 168, the insert member 176 stops rotating and remains stationary relative to the container 168 while the body member 162 continues to rotate until the flange 172 of body member 162 firmly engages the top of flange 178 of insert member 176 and presses the insert member 176 into tight sealing engagement with the container 168. Under these conditions the seal element 200 is clearly visible through the insert member 176 to indicate that the package is in its initially closed position.

In the initially closed condition, the seal element 200 is firmly attached to both the container 168 and to the insert member 176. Consequently, any rotation of the body member 162 in an opening direction will move the insert member 176 axially and cause fracture of the seal element 200. If the closure 160 should be reclosed, such a fracture will be visible through the insert member 176 to make tampering apparent. When the closure is fully removed, the seal element 200 can be completely removed from the container 168 for dispensing of the contents of the container and thereafter the closure, which now will consist of the body member 162 and the insert member 176 can be used repeatedly to open and close the container 168. In a closed condition, the soft polyethylene insert member 176 and particularly the flange 178 acts to seal the container.

The disc shaped seal element 200 can be made similar to the seals 30 and 82 of the prior embodiments, and as with the liner 80 of closure 70, the seal 200 can be bonded by adhesive or induction heating to the sealing lip 202 of the container 168 and can be bonded by adhesive or the like to the central portion 190 of the cap member 176. In addition the liner member 176, like the liner 80, is made of transparent, relatively resilient and soft plastic. For example, a low density, polyethylene with an ethylene acetate additive to make the liner relatively soft and pliable giving it, not only transparency, but also a softness for sealing characteristics.

In the preferred form of the closure shown in FIGS. 12 and 13, the printed seal element 200 adheres to the bottom surface of central portion 190 and this bond terminates at the annular groove 194 with no adherence of the seal element to bottom surface of flange 178. With the seal element 200 firmly affixed to the top lip 202 of container 168, a complete fracture of the seal element occurs as the body member moves axially during unthreading.

The seal element can be supplied without an adhesive facing, and the adhesive can be applied to the central portion 190 of insert member 176 and to the top lip 202 of the container 168 to produce the tamper indicating closure in which the seal is destroyed upon initial opening.

In instances where it is desired to produce a tamper indicating closure 160 so that the seal element 200 is not self-destructing upon initial opening, such as closure 12 of FIG. 1 or the closure 70 of FIG. 10, only the bottom side of printed seal element 200 would have an adhesive facing or, alternatively, adhesive would be applied to the top lip 202 of the container.

Closure 160 can be further simplified, but still have the advantage of offering an insert member which can be snapped into the body member to provide a non rotating unitary structure or one in which the body can be rotated while the insert remains stationary, and to provide a structure in which the seal element is self-destructing upon initial opening or which the seal element must be removed after unthreading the body member, the closure can be manufactured in accordance with the invention disclosed in FIGS. 14 and 15.

Closure 204 includes a cylindrical body member 206 having internal threads 164 for engagement with complementary threads 166 on the neck of container 168. The cylindrical body member 206 is open at its opposite ends to form a lip 170 at the lower open end to receive the neck of container 168. The opposite end of the body member 206 can have a punched circular opening 208 providing an annular flange 172. Insert member 210 includes a generally flat disc portion 212 and a tubular portion 214 which projects upwardly therefrom and is received in body opening 208. The upper end of the tubular portion of insert member 210 is provided with an annular bead 216 which will confine annular body flange 172 when the insert is snapped into the body member.

Insert 210 is made of a transparent, relatively resilient and soft plastic like the liner 80. The insert and body member may be so dimensioned that when the insert is snapped into the body member, a unitary structure is formed with the insert sealing against the body member or it may be dimensioned so that the insert is free to rotate with respect to the body member as provided for in closure 160.

In the closed condition of closure 204, a destructible seal 200 is disposed in the closure body 206 in contact with disc portion 212 of insert 210. As in the prior embodiments of the invention, the seal 200 can be bonded by an adhesive or induction heating to the sealing lip 202 of the container 189 to seal the contents within the container. After the package has been filled and sealed for the first time, the seal element 200 is clearly visible through the transparent insert 210 to indicate its condition. In normal use, the closure 204 is removed leaving the seal element 200 affixed to the container lip 202. The seal element can be broken and removed in its entirety to use the contents of the container. When the closure is replaced on the container, the absence of the sealing member 200 is clearly visible and the insert acts as a sealing member with the lip 202 of the container neck.

The body member 206 may be molded with the opening 208 formed with a lead in chamfered surface 218 and a top ledge 220 to aid in the assembly of the insert member to body member as shown in FIG. 15.

Where the top lip 202 of the container is likely to be irregular, an annular bead 222 can be molded integrally with insert 210 or a separate bead 222 of a plastisol may be applied to the underside of the plane or disc portion 212 of insert 210. This supplies a yielding surface to conform with the irregularities of the top lip 202 both during the initial sealing with the sealing element 200 and in reclosure after the sealing element 200 has been removed.

Closure 204 can be self destructing upon initial opening if the seal element 200 is attached or otherwise made to adhere to the insert member 210 as, for example, in the manner of closure 160 of FIGS. 12 and 13.

The embodiments of the invention in which an exclusive property or privilege is claimed are defined as follows:

1. A tamper indicating closure for use with a container having a neck containing an opening, comprising, in combination: a body member having a generally flat top and a cylindrical skirt extending therefrom, said top having a central portion constructed of a transparent material and extending substantially continuously along one end of said skirt, said skirt containing means for detachable attachment to said container neck; a destructible seal element for closing said container opening, said seal element being constructed of a frangible material; and means for sealingly bonding said seal element to said container neck so that removal of said seal element from around said container opening results in destruction of said seal element, said seal element being visible through the top of said body member to indicate its integrity or tampering.

2. The tamper indicating closure of claim 1 further including a transparent insert member of a yieldable soft plastic material having a planar surface and asembled to said body member by insertion into said skirt into contact with said top, said destructible seal element being continuously visible through said insert member and the top of said body member.

3. The tamper indicating closure of claim 2 wherein the top of said body member has a central opening with a surrounding annular flange connected at its periphery to said cylindrical skirt, said insert contacting said flange, and said seal element being continuously visible through said opening and said insert member.

4. The tamper indicating closure of claim 3 wherein said insert member has a tubular projection extending from said planar surface for engagement with said opening for retention of said insert member relative to said body member.

5. The tamper indicating closure of claim 4 further including an outwardly extending retention bead at the free end of said tubular projection maintaining said insert member in said body member but permitting relative rotation therebetween, thereby allowing said insert member and seal element to remain stationary relative to said container during closing rotation of said body member.

6. The tamper indicating closure of claim 3 wherein said insert member is supported in said body member for rotation relative thereto so that upon application of said closure to said container, said insert member and said seal element will remain stationary relative to said container during closing rotation of said body member.

7. The tamper indicating closure of claim 6 further including means limiting axial movement of said insert member relative to said body member.

8. The tamper indicating closure of claim 7 further including means attaching said seal element to said insert member, whereby upon unthreading of said body member from said container, said insert member will move axially with said body member thereby damaging said seal element to indicate tampering.

9. The tamper indicating closure of claim 3 further including means attaching said seal element to said insert member and means limiting axial movement of said insert member relative to said body member, whereby upon unthreading of said body member from said container, said insert member will move axially with said body member thereby damaging said seal element to indicate tampering.

10. The tamper indicating closure of claim 3 further including an annular bead on the underside of the planar surface of said insert member which yields to conform to said container opening with said seal element therebetween during initial application of said closure to said container and to conform to said container opening to reseal said container upon removal of said seal element therefrom.

11. The tamper indicating closure of claim 1 wherein said seal element is provided with indicia to enhance detection of seal element fracture.

12. The tamper indicating closure of claim 11 wherein said indicia is printed on said seal element.

13. The tamper indicating closure of claim 12 wherein said indicia is printed on said seal element as a worded message indicating the seal integrity.

14. The tamper indicating closure of claim 1 wherein said means for attachment to said container neck includes threads on said body member skirt for engagement with complementary threads on said container neck.

15. The tamper indicating closure of claim 14 wherein said seal element is positioned in contacting relationship with the underside of said flat body member top within said cylindrical skirt, and said seal becomes bonded to said container neck upon initial threading application of said closure to said container neck.

16. The tamper indicating closure of claim 15 wherein access is obtained to said container by unthreading and removing said closure from said container neck and puncturing said destructible seal element.

17. The tamper indicating closure of claim 1 wherein said seal element is fastened to the underside of said flat body member top whereby said seal element is fractured upon initial movement of said closure to remove it from said container neck.

18. The tamper indicating closure of claim 17 wherein said seal element is fastened to said flat body member top by bonding.

* * * * *